US005871260A

United States Patent [19]

Delli-Gatti, Jr.

[11] Patent Number: 5,871,260

[45] Date of Patent: Feb. 16, 1999

[54] MINING ULTRA THIN COAL SEAMS

[76] Inventor: Frank A. Delli-Gatti, Jr., c/o P.O. Box 1085, Beckley, W. Va. 25801

[21] Appl. No.: 797,734

[22] Filed: Feb. 11, 1997

[51] Int. Cl.[6] ..... E21C 41/18; E21C 35/24; E21C 35/20

[52] U.S. Cl. ..... 299/19; 299/30; 299/64

[58] Field of Search ..... 299/10, 19, 30, 299/64, 67; 198/518

[56] References Cited

U.S. PATENT DOCUMENTS

| | | | |
|---|---|---|---|
| 3,874,735 | 4/1975 | Delli-Gatti, Jr. | 299/68 |
| 3,968,995 | 7/1976 | Artenzen | 299/76 |
| 4,090,601 | 5/1978 | Freed, Jr. | 198/316 |
| 4,133,582 | 1/1979 | Kogelmann | 299/64 |
| 4,281,876 | 8/1981 | Lansberry | 299/30 X |
| 4,664,448 | 5/1987 | Frenyo | 299/67 |
| 5,720,527 | 2/1998 | Sartaine et al. | 299/64 |

FOREIGN PATENT DOCUMENTS

| | | | |
|---|---|---|---|
| 1079757 | 6/1980 | Canada | 299/19 |
| WO 83/00525 | 2/1983 | WIPO . | |

OTHER PUBLICATIONS

CM245–II Continuous Miner brochure, Lee–Norse, 1984.
CM285–II Continuous Miner brochure, Lee–Norse, 1984.
Toshiba CCD Color Camera IK–M41A instruction manual, cover sheet and pp. 1, 3, and 16, circa 1990.

*Primary Examiner*—David J. Bagnell
*Attorney, Agent, or Firm*—Nixon & Vanderhye P.C,

[57] ABSTRACT

A continuous mining machine is provided for mining ultra thin coal seams, e.g. seams having a thickness of about 24 inches or less. A chassis supported by crawler tracks has a substantially horizontal axis powered cutter head mounted to its front and a conveyor extending from a gathering head toward the rear of the chassis. The conveyor includes a conveyor chain driven by at least one motor near the rear of the chassis for driving a sprocket. The gathering head includes a pair of counter-rotating discs with upstanding vanes and a deck having a maximum angle of about 10° with respect to the dimension of elongation of the chassis. A small diameter idler sprocket for the conveyor chain is mounted beneath the deck, and a small diameter drive sprocket is provided for the cutting chain of the cutting head. The mining machine is controlled to keep it within a coal seam to be cut by using a first color video camera scanning the ceiling of the bore cut by the miner, and a second color video camera facing the floor. The mining machine may be used in a method of mining in which, after formation of a main bore of about 300–600 feet long, during withdrawal the machine forms a number of angled bores each roughly as long as the length of the machine.

30 Claims, 7 Drawing Sheets

MINING ULTRA THIN COAL SEAMS

BACKGROUND AND SUMMARY OF THE INVENTION

There are literally millions of tons of coal in the United States alone that are found in thin coal seams (having a thickness of about four feet or less), and ultra thin coal seams (having a thickness of around two feet or less). Utilizing conventional equipment and techniques the vast majority of this coal is unrecoverable. While auger miners can be successful in thin and ultra thin seams, augers are very limited in the depth of bore they can form (typically limited to about 150 feet), and because of the circular bores that they form leave a great deal of coal between penetrations. It was for that reason that the continuous mining machine in U.S. Pat. No. 3,874,735 (the disclosure of which is hereby incorporated by reference herein) was developed. That mining machine, marketed in commercial form by Lee-Norse under the trade designations CM245 and CM285, is the shortest continuous miner (non-auger) believed to ever have been commercialized. For example the CM245 has a chassis height of only about 24 inches, and can be used in coal seams as thin as 30 inches. While that machine is a significant advance in the art and has great functionality for a number of thin coal seams, its design makes it—as a practical matter—impossible to reduce its size further to allow it to be used in ultra thin coal seams.

According to the present invention a continuous mining machine is provided which uses the same basic concepts of the CM245 and 285, such as shown in U.S. Pat. No. 3,874,735, but makes a few changes to the construction that allows it to be made even shorter, so that is can effectively mine coal seams having a thickness of about 24 inches or less. The continuous mining machine according to the invention has a chassis height of only about 19 or 20 inches, and a maximum cutter diameter of about 22 inches (preferably 21 inches), yet it can effectively mine coal in seams. The mining machine according to the invention is also preferably controlled utilizing color cameras which scan at least the ceiling and the floor of a bore being formed to ensure that coal is primarily being cut rather than surrounding rock. Also according to the present invention a continuous mining machine can be utilized in an unusual technique for recovering as much coal as possible from a single complete penetration by forming angled bores into the side walls of the main bore as the mining machine is being withdrawn. Utilizing the mining machine according to the invention rather than being restricted to a bore length of about 150 feet, such as is conventional with augers, bores from 300 to 600 feet may be constructed, with additional coal recovered during withdrawal.

According to one aspect of the present invention a continuous mining machine is provided comprising the following components: A chassis supported by crawler tracks, and having a front and a rear and elongated in a first dimension between the front and the rear. A substantially horizontal axis powered cutter head mounted to the front of the chassis. A conveyor mounted to the chassis and including an endless conveyor chain. The chain connected to first and second sprockets, the first sprocket mounted for rotation about a first shaft adjacent the rear of the chassis, and the second sprocket mounted for rotation about a second shaft adjacent the front of the chassis but between the first sprocket and the cutter head. The first; and second shafts rotatable about axes generally perpendicular to the first dimension. And, at least one motor mounted adjacent the rear of the chassis for driving the first shaft to thereby drive the first sprocket and the conveyor.

The second shaft preferably comprises an idler shaft, and the machine further preferably includes a gathering head mounted adjacent the front of the chassis and below the cutter head and at least partly to the rear of the cutter head, for gathering material cut by the cutter head and moving the cut material to the conveyor. The gathering head preferably comprises a pair of counter-rotating discs with upstanding vanes, and an angled deck substantially coplanar with the discs; and wherein the second shaft has first and second transmission elements connected thereto, the first and second transmission elements operatively connected to the discs for effecting counter-rotation driving thereof. The angled deck, during normal operation, makes a maximum angle of about 10° with respect to the dimension of elongation of the chassis. The chassis has a maximum height of about 20 inches (e.g. a height of about 19 inches) and the cutter head has a maximum effective diameter of about 22 inches (e.g. about 21 inches), as further explained below. The second sprocket has a maximum diameter of about eight inches and is mounted beneath the deck, and preferably includes four tapered teeth. A plurality of cross bars are preferably connected to the chain for moving conveyed material (typically coal) from the gathering heads to the rear of the chassis.

The cutter head drive is also preferably specially constructed so that it is assured that a minimum height can be achieved. For example the drive sprocket or sprockets (typically two are provided adjacent opposite ends of a shaft) preferably comprises a five tooth sprocket having a maximum diameter of about 7.5 inches (e. g. about 7.02 inches) on about a four inch diameter shaft, with the cutting head effective diameter (the trace of the cutting chain bits) at that area of about 16 inches or less (e. g. about 15.3 inches). The driven sprocket at the front of the head, where the actual cutting is done, may comprise a ten tooth sprocket with a maximum diameter of about 14 inches (e. g. about 13.35 inches), and with the cutting head effective diameter a maximum of about twenty two inches (e. g. about 21.04 inches). The cutting chain may comprise a conventional cutting chain having alternating connector and cutting bit links, e. g. Number 73473 clearance chain available from The Cincinnati Mine Machinery Co. of Cincinnati, Ohio.

The mining machine further comprises a first color video camera mounted on the chassis or the cutter head in a position to scan material being cut above the cutter head and utilizable to determine the color thereof, the first video camera connected to a monitor to the rear of the chassis. The mining machine forms a floor during operation, and preferably further comprises a second color video camera mounted to the chassis or the cutter head in a position to scan the floor cut by the mining machine and utilizable to determine the color thereof, the second video camera connected to the monitor.

The second shaft typically has first and second transmission elements (preferably gears) connected thereto, the first and second transmission elements operatively connected (through other gears in the preferred embodiment) to the discs for effecting counter rotation driving thereof.

According to another aspect of the present invention a continuous mining machine is provided comprising the following components: A chassis supported by crawler tracks, and having a front and a rear and elongated in a first dimension between the front and the rear. A powered cutter head mounted to the front of the chassis. A conveyor mounted to the chassis and including an endless conveyor chain. The chain connected to first and second sprockets, the first sprocket mounted for rotation about a first shaft adjacent the rear of the chassis, and the second sprocket mounted for rotation about a second shaft adjacent the front of the chassis but between the first sprocket and the cutter head. The first and second shafts rotatable about axes generally perpendicular to the first dimension. At least one motor for driving one of the first and second shafts to thereby drive one of the sprockets and the conveyor. A gathering head mounted adjacent the front of the chassis and below the cutter head and at least partly to the rear of the cutter head, for gathering material cut by the cutter head and moving the cut material to the conveyor, the gathering head comprises a pair of counter-rotating discs with upstanding vanes, and an angled deck substantially coplanar with the disc. The second shaft having first and second transmission elements connected thereto, the first and second transmission elements operatively connected to the discs for effecting counter-rotation driving thereof. The angled deck during normal operation making a maximum angle of about 10° with respect to the dimension of elongation of the chassis. And, the chassis having a maximum height of about twenty inches, and the cutter head having a maximum diameter of about twenty two inches. The second sprocket has a maximum diameter of about eight inches and is mounted beneath the deck.

The invention also relates to a method of mining coal in thin seams. The mining machine described above is particularly suited for practicing the method of the invention, although other mining machines also may be utilized. According to the method of the present invention seams having an average thickness of less than four feet may be mined utilizing a continuous mining machine having a chassis mounted by crawler tracks, a cutter head at the front of the chassis, an articulated rear end, a first conveyor for conveying cut coal from the cutter head to the rear of the chassis, and a second conveyor operatively associated with the rear end to convey coal from a bore toward a mouth of the bore, the continuous miner having a predetermined length from the cutter head to the rear of the chassis. The method preferably comprises the steps of: (a) Forming a main mine bore, having first and second side walls, a roof, and a floor, by powering the crawler tracks and cutter head to move the continuous miner through the mine mouth into the coal seam a depth of more than 150 feet in a first direction, while cutting coal and conveying the coal toward the mouth using the first and second conveyors. (b) After the practice of step (a), retracting the continuous miner a distance of greater than about ten feet. And, (c) after the practice of step (b), forming a secondary mine bore by powering the crawler tracks and the cutter head to move the continuous miner into the coal seam through the main mine bore side walls at an angle of greater than about 20° and less than about 80° (e.g. between about 30°–50°) to the first direction for a distance roughly equal to the predetermined length of the miner (e.g. between about 20–40 feet), while cutting coal and conveying cut coal toward the mouth using the first and second conveyors.

The method also preferably comprises the further step (d) of repeating steps (b) and (c) at least once during the practice thereof. Step (c) is typically practiced by moving the mining machine into contact with the first side wall of the main bore, and step (d) is practiced after (c) by moving the miner into contact with the second wall of the main bore. Step (d) is also practiced a plurality of times, alternating between moving the miner into contact with the first side wall and the second side wall of the main bore. The method may be practiced in coal seams having an average thickness of about three feet or less, and even in ultra thin coal seams having an average thickness of about two feet or less.

Preferably during the practice of step (a) the miner is remotely controlled by a human operator, and the miner has at least a first color video camera mounted thereon; and the method preferably comprises the further step (d) of scanning the roof of the bore adjacent the cutter head to determine the color thereof, and then the human operator adjusting, if necessary, the position of the cutter head and the vertical orientation of the miner in response to that scanning. The miner typically also has a second color video camera mounted thereon, and there is the further step (e) of scanning the floor of the bore with the second video camera to determine the color thereof, and then the human operator adjusting, if necessary, the position of the cutter head and the vertical orientation of the miner in response to that scanning.

Step (a) is typically practiced to penetrate the coal seam a distance of over 150 feet, typically between about 300–600 feet. The mining machine utilized in the practice of the method of the invention typically has a length of about 25 to 30 feet (e.g. about 28 feet), and in any event steps (c) and (d) are typically practiced to penetrate the coal seam a distance of between about 20–40 feet in forming each secondary bore.

It is the primary object of the present invention to provide a continuous miner, and mining method, that can mine ultra low thickness coal seams to a depth of more than 150 feet without putting a human operator at risk. This and other objects of the invention will become clear from an inspection of the detailed description of the invention and from the appended claims.

DETAILED DESCRIPTION OF THE DRAWINGS

Figure 1:
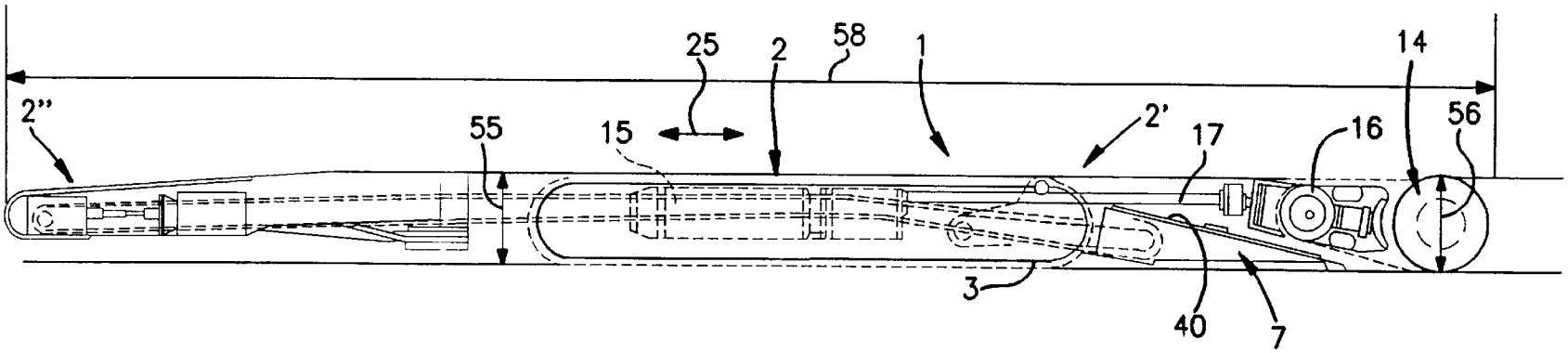
FIG. 1 is a side schematic view of a preferred embodiment of an exemplary continuous mining machine according to the present invention.

The basic components of the mining machine 1 according to the present invention are the same as or similar to the components of the machine of U.S. Pat. No. 3,874,735, the disclosure of which is incorporated by reference herein. In particular the mining machine 1 includes a chassis 2 supported by conventional crawler tracks 3 and having a front end 2' and a rear end 2". The chassis carries a conveyor shown generally by reference numeral 4 running from the front 2' to the rear 2" including to a tail piece 5 of the chassis 2 mounted by an articulated joint 6. A gathering head 7 is pivoted on the front of the chassis 2 and extends forwardly therefrom for conveying coal to the forward end of the conveyor 4. The conveyor 4 preferably includes a metal trough having the usual side flanges 8 (see FIG. 2) and a chain 9 with cross bars 10 for carrying material along the conveyor trough. A boom 11 is pivotally mounted on the front end 2' of the chassis 2 generally at 12 (see FIG. 2) to extend upwardly and forwardly therefrom and is raised up and down by a pair of hydraulic cylinders 13 mounted between the chassis 2 and a portion of the boom 11. A substantially horizontal axis powered cutter head 14 is mounted to the front of the chassis 2', via the boom 11, and electric motors 15 are mounted on the sides of the chassis 2 and are connected to transmissions 16 mounted on the outer sides of the boom 11 by the shafts 17 having a universal joint 18 at at least one end thereof and splined telescopic joints 19. The cutter head 14 is (except for size, as described with respect to FIG. 9) conventional, as shown in U.S. Pat. 3,874,735 or as utilized in the CM 245 and CM 285, or any other suitable cutter head, and includes cutter bits 20.

The chain 9 is mounted by a first sprocket 21 (best seen schematically in FIG. 3) mounted for rotation about a first shaft 22 adjacent the rear 2" of the chassis 2, and a second sprocket 23 (best seen schematically in FIGS. 3 and 4) mounted for rotation about a second shaft 24 adjacent the front 2' of the chassis 2 but between the first sprocket 21 and the cutter head 14. The shafts 22, 24 are rotatable about axes generally perpendicular to the dimension of elongation 25 of the chassis 2. Intermediate sprockets 26, 27 (see FIG. 3) may be provided as necessary or desirable for properly guiding the chain 9, or the trough with side walls 8 alone may provide the guiding action.

Figure 2:
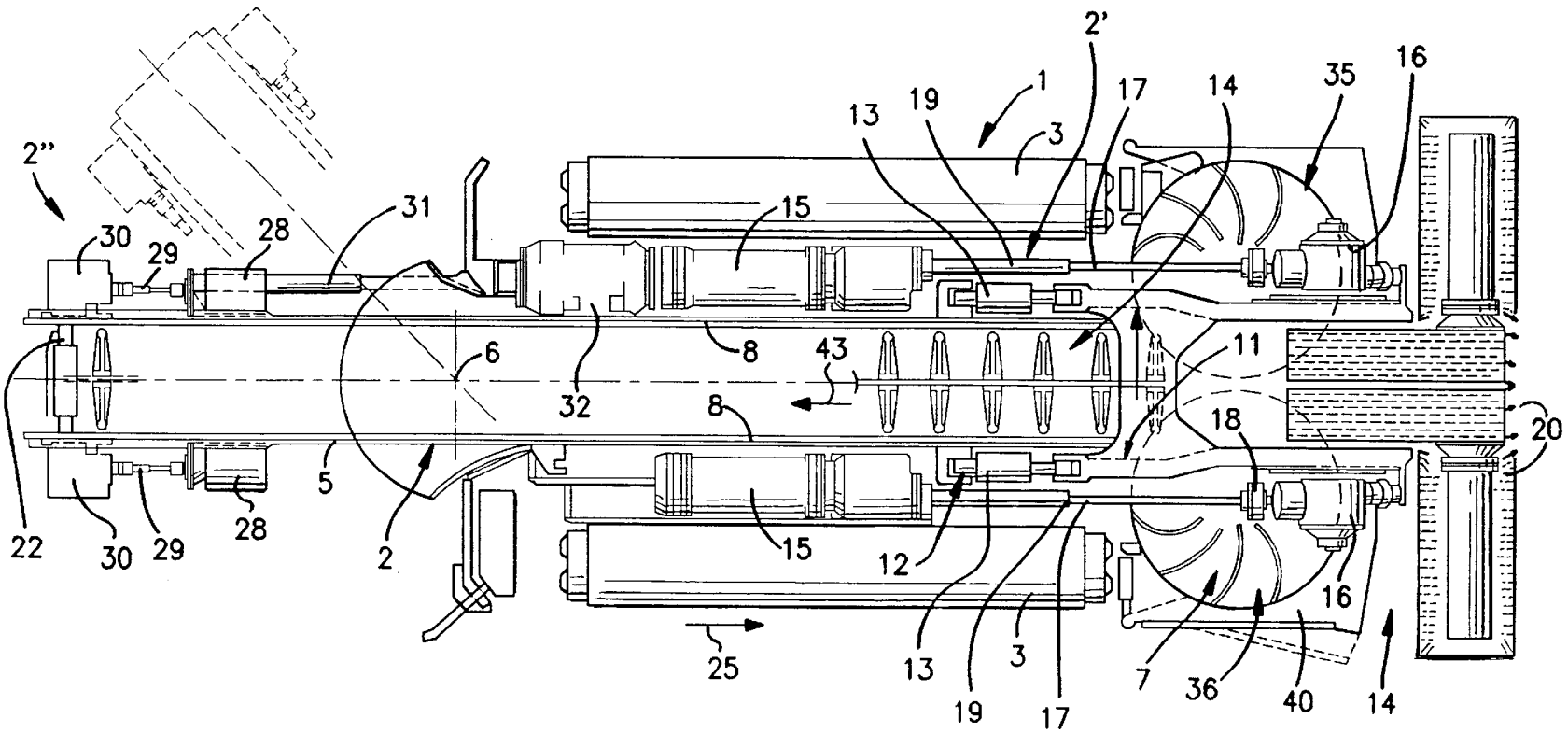
FIG. 2 is a top plan view of the mining machine of FIG. 1.

In U.S. Pat. No. 3,874,735 the chain 9 is powered by motors mounted adjacent the front of the chassis 2, with the front sprocket (comparable to the sprocket 23 of FIGS. 3 and 4) being the powered sprocket. However that location of the motors is one of the factors of the design of the U.S. Pat. No. 3,874,735 (and the CM 245 and CM 285 commercial machines implementing that patent) that preclude a reduction in the height thereof. According to the invention, however, this is solved by utilizing at least one motor 28 (e.g. two motors 28 as seen in FIG. 2) mounted adjacent the rear 2" of the chassis 2 (past the articulated connection 6). The motors 28 drive the shaft 22 through telescoping and splined transmission shafts 29 (see FIG. 2) and gear boxes 30, the splined telescoping shafts 29 being preferred in order to allow articulation of the tail 5 of the chassis 2 about the pivot point 6, e.g. by extending or retracting the hydraulic cylinder 31. A hydraulic pump motor 32 is preferably provided for powering all of the hydraulic components of the machine 1, and the motors 28 may be hydraulic or electric but preferably are electric. Hydraulics are typically used for the cylinders 13 and 31 and for powering the gathering head up or down as necessary, while electric motors are used for the motors 15 and 28, and for the crawler 3 drives also. The crawler motors are conventional and are inside the crawlers 3.

In operation of the mining machine 1 another conveyor is provided at the end 2" of the chassis to convey the cut material to the bore mouth. That conveyor—which is shown only schematically at 33 in FIG. 5—may be any conventional type of conveyor that can be constructed in a size sufficient for use with the mining machine 1, and the particulars of the conveyor 33 are not part of this invention.

Since the drive motors 28 for driving the conveyor chain 9 are located adjacent the rear 2" of the chassis 2 rather than at the front adjacent or beneath the gathering head 7, it is possible to reduce the height of the mining machine 1 significantly by making various other changes to the gathering head 7 and components associated therewith. The gathering head 7 includes first and second counter-rotating discs 35, 36 (see FIGS. 2 and 4) each with upstanding vanes 37, and typically rotating in the directions 38, 39 illustrated in FIG. 4. An angled deck 40 is substantially coplanar with the discs 35, 36 and is disposed at an angle a (see the schematic representation in FIG. 3) with respect to the dimension of elongation 25, and the floor 41 of the bore 42 (see FIGS. 5 and 6) being mined by the machine 1. In the machine of U.S. Pat. No. 3,874,735, and the commercial embodiments thereof in the CM 245 and CM 285 miners, the angle $\alpha$ is about 15°–16° during normal operation of the machine 1. However because no motors are present thereat and because the sprocket 23 may be made smaller according to the invention, the angle $\alpha$ is a maximum of about 10° during normal operation of the machine 1 according to the present invention, and is typically about 8° or 9°.

Figure 3:
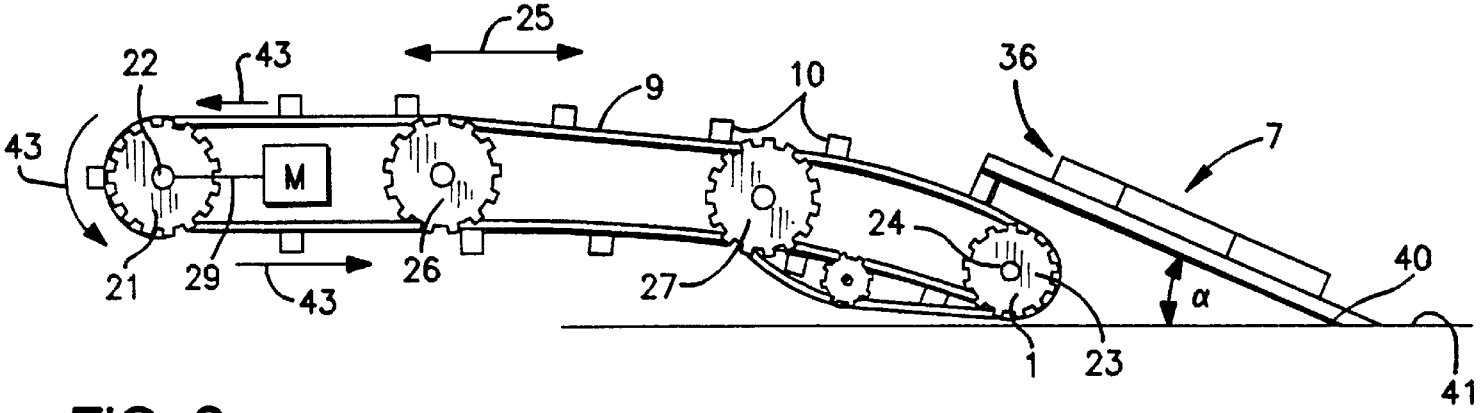
FIG. 3 is a side schematic view, with components removed for clarity of illustration, showing the operation of the conveyor chain and angled deck and gathering head of the mining machine of FIGS. 1 and 2.
Figure 4:
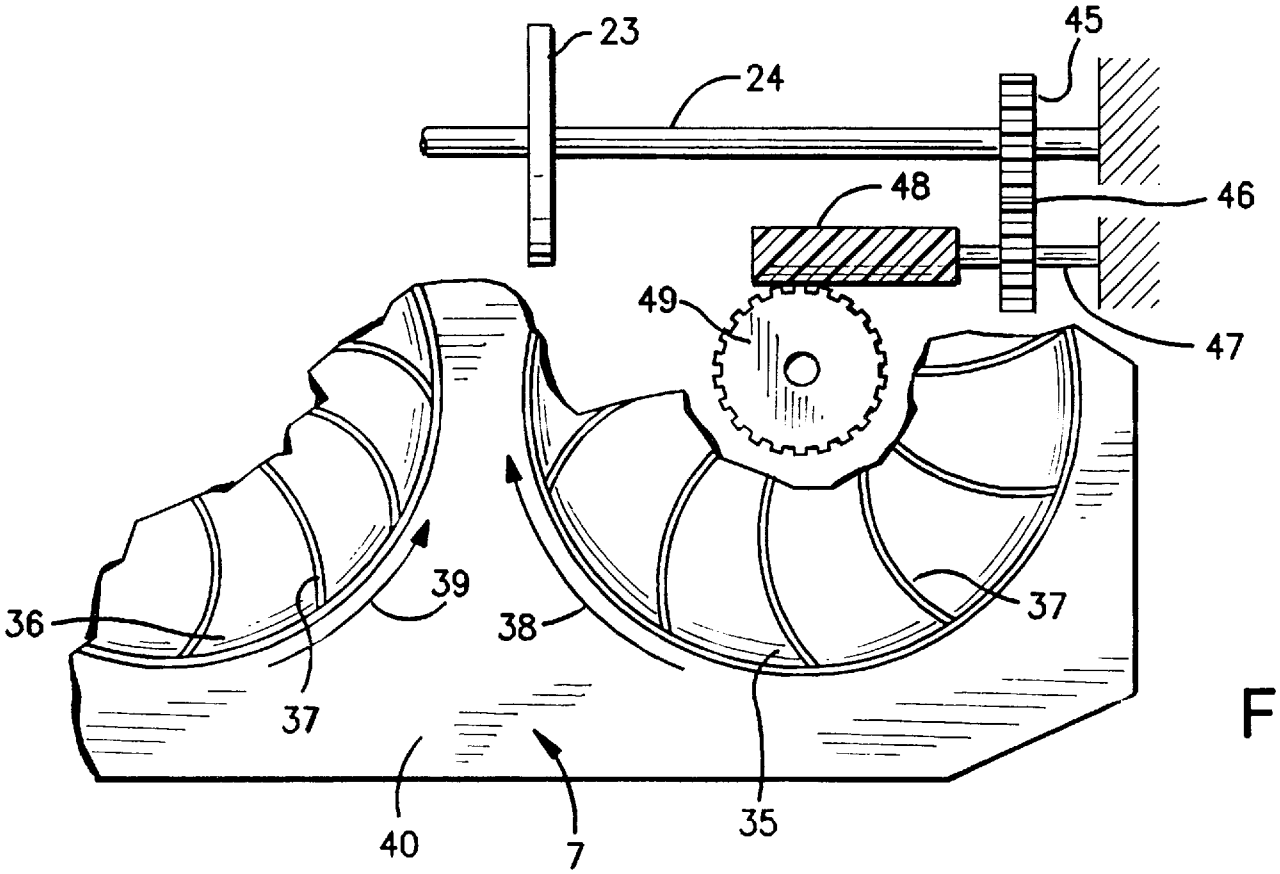
FIG. 4 is a top plan schematic detail view, with many structures cut away for clarity of illustration, showing the operation of the gathering head of the mining machine of FIGS. 1 through 3.
Figure 8:
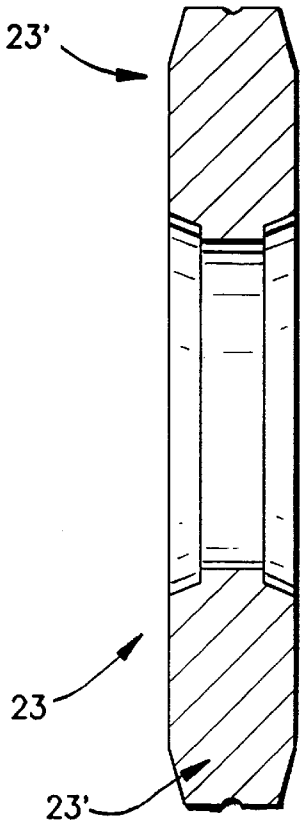
FIG. 8 is a cross-sectional view of the sprocket of FIG. 7 taken along lines 8—8 thereof.
Figure 7:
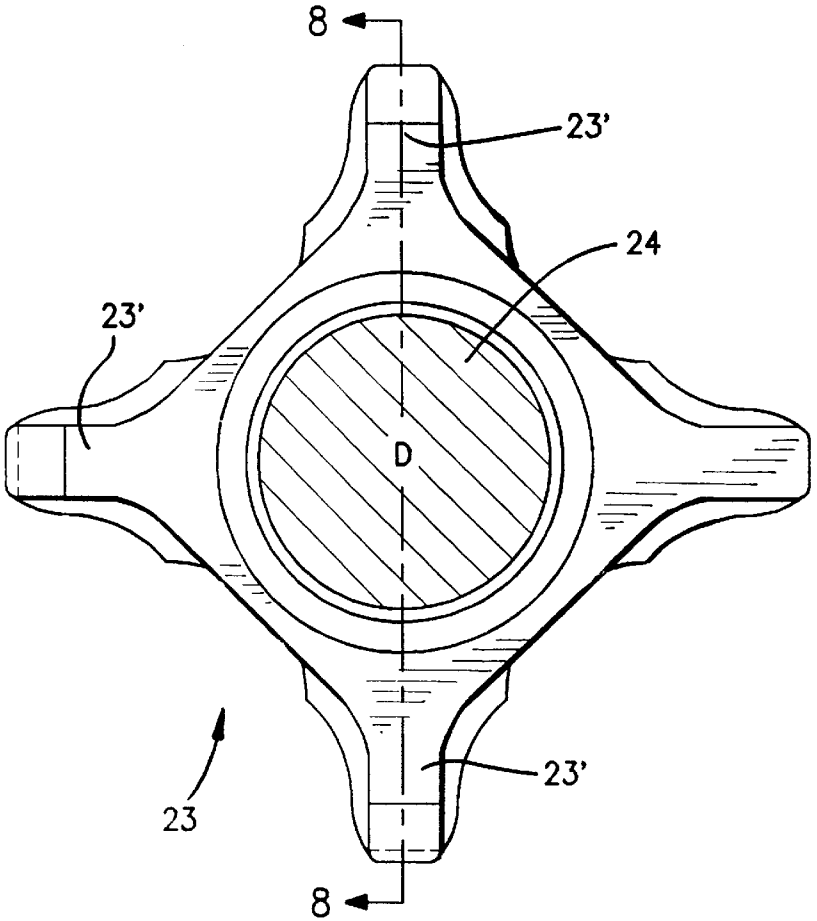
FIG. 7 is a side view of an exemplary conveyor chain idler sprocket according to the present invention.

The second sprocket 23, as seen schematically in FIGS. 3 and 4, is made as small as possible while still being able to properly guide the chain 9 as the idler shaft 24 rotates as the chain 9 is powered by the sprocket 21 in the direction of the arrows 43 (see FIG. 3). Typically the sprocket 23 has a maximum diameter D (see FIG. 7) of about eight inches, preferably about 7.2–7.3 inches. This is the smallest size feasible if the shaft 24 is a three inch diameter shaft, while still being able to get the proper horsepower so that the chain 9 is driven to ensure that the coal or other material being cut clears the gathering head 7 and is conveyed away while the machine 1 powered cutting head 14 may be driven at an average radial speed of about 650 feet per minute (which is best for dust control, bit life, and the like). As seen in FIG. 3 the sprocket 23 is preferably mounted beneath the angled deck 40 so that the coal is moved up by the discs 35, 36 directly onto the trough having the side walls 8 which the conveyor bars 10 traverse. The sprocket 23 preferably has the configuration illustrated in FIGS. 7 and 8, i.e. four teeth 23' with the particularly shaped ends seen in FIGS. 7 and 8, although a three tooth configuration is also feasible.

FIG. 4 schematically illustrates one exemplary manner in which the counter-rotating discs 35, 36 may be driven. The illustration in FIG. 4 is essentially the same as that in the U.S. Pat. No. 3,874,735, except it being understood that the shaft 24 is an idler shaft which is driven by the chain 9 rotating the sprocket 23 as powered by the motors 28.

Connected to the shaft 24 in the FIG. 4 embodiment is a transmission element 45 which is operatively connected to the disc 35 for rotating it in the direction 38. In the preferred embodiment the transmission element 45 is a gear, such as in the U.S. Pat. No. 3,874,735 and the CM 245 and CM 285 machines. The gear 45 cooperates with another gear 46 mounted on a shaft 47, the shaft 47 also including a worm gear 48 which cooperates with a gear 49 on the bottom of the disc 35 to effect rotation thereof in the direction 38. While gears 45, 46, 48, 49 are preferred transmission elements the exact gear construction may be changed depending upon the particular results desired, and other conventional transition elements (such as chains and sprockets, cams and followers, mechanical linkages, and the like. While not shown in FIG. 4, the shaft 24 includes another transmission element preferably just like the element 45 at the opposite end thereof for cooperation with the disc 36 to rotate it in the direction 39 in a substantially identical manner.

Figure 9:
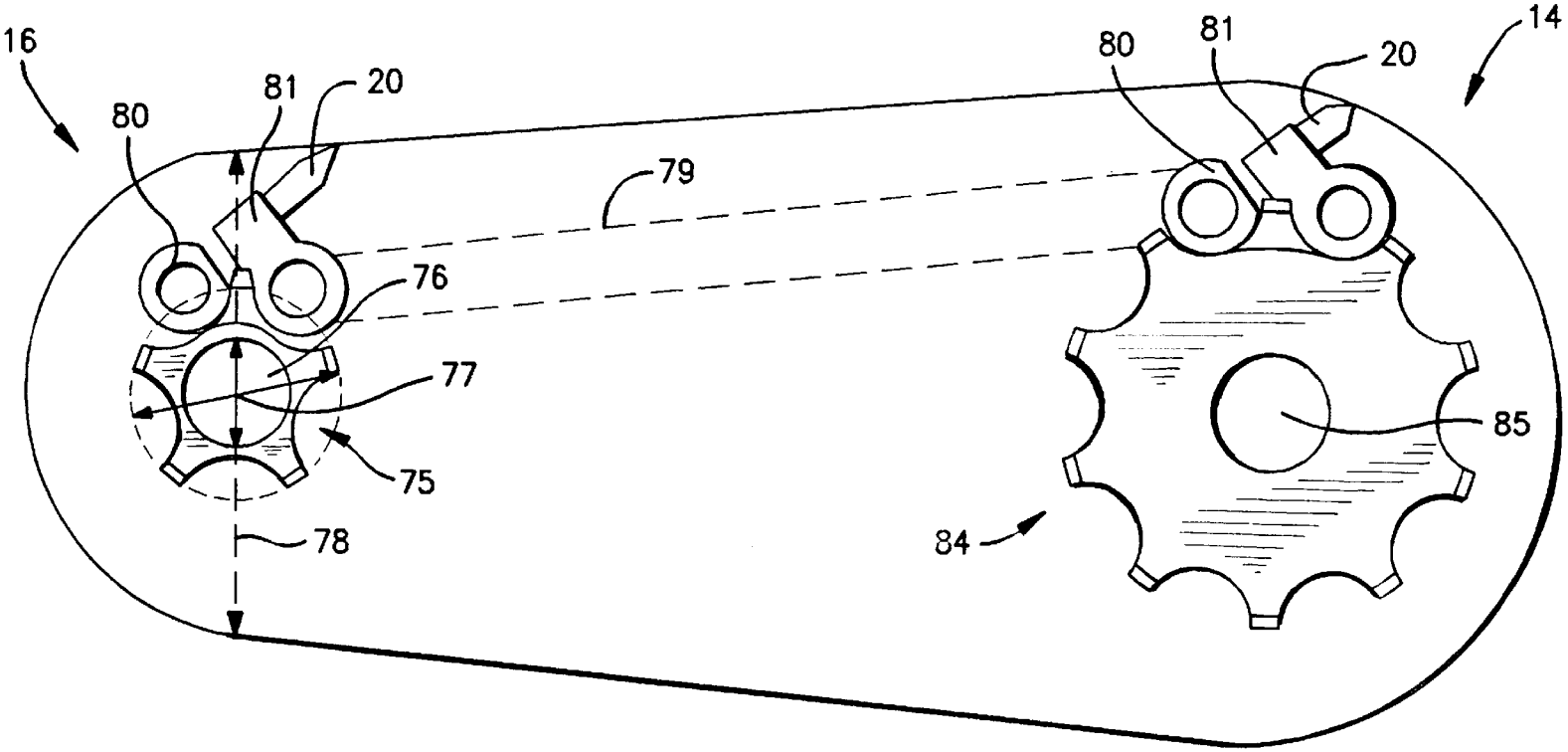
FIG. 9 is a side detail schematic view showing exemplary sprockets for the cutting head for driving the cutting chain for an exemplary machine according to the invention.

Details of an exemplary substantially horizontal axis cutting head 14 and transmission element 16 for use with the mining machine 1 according to the invention, to insure that the machine 1 will have an appropriately minimum size while still effectively performing its desired functions, is illustrated in FIG. 9. For example the drive sprocket 75 (typically two sprockets 75, one for each transmission element 16, are provided adjacent opposite ends of a shaft 76) preferably comprises a five tooth sprocket having a maximum diameter 77 of about 7.5 inches (e. g. the pitch diameter 77 is about 7.02 inches) on an about four inch diameter shaft 76, with the cutting chain 79 effective diameter 78 (the trace of the cutting chain bits 20) at that area of about 16 inches or less (e. g. diameter 78 is about 15.3 inches).

The boom 11 may have a stop (not shown) mounted thereon to positively insure that no part (e. g. bits 20) of the cutting chain 79 of the cutter head 14 can come into contact with any part of the gathering head 7. The stop may take the form of a simple block of metal welded or otherwise attached to a part of the boom 11 near the top of the gathering head 7 pan (i. e. angled deck 40), the block dimensioned so that when it engages the pan/deck 40 the cutting chain bits 20 are spaced slightly from all parts of the head 7.

The cutting chain 79 may comprise a conventional cutting chain having alternating connector links 80 and cutting bit links 81 (the links 81 mounting the cutting bits 20), e. g. a Number 73473 clearance chain available from The Cincinnati Mine Machinery Co. of Cincinnati, Ohio. The driven sprocket 84 (again two are typically provided, one at either end of shaft 85, and cooperating with a sprocket 75) at the front of the head 14, where the actual cutting is done, may comprise a ten tooth sprocket with a maximum diameter (pitch diameter) of about 14 inches (e. g. about 13.35 inches), and with the cutting head 14 effective diameter a maximum of about twenty two inches (e. g. about 21.04 inches).

Figure 5:
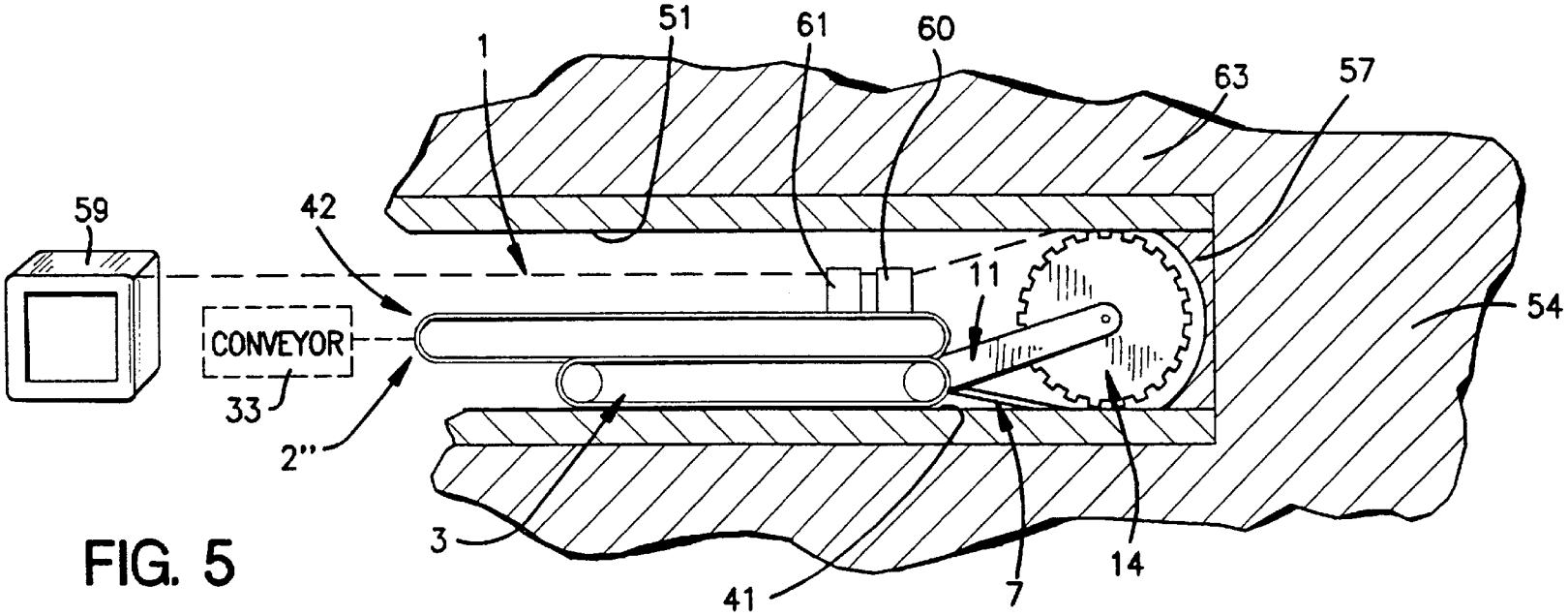
FIG. 5 is a schematic side view showing the use of the mining machine of FIGS. 1 through 4 in a coal seam and the continuous mining thereof.

FIG. 5 schematically illustrates utilization of the mining machine 1 to form a bore 42 including forming a floor 41, a ceiling 51, and (see FIG. 6) first and second side walls 52, 53. The machine 1 is typically advanced by powering the crawlers 3 and by moving the cutting head 14, the tail 5, the gathering head 7, and the other components, in essentially the same manner as in U.S. Pat. No. 3,874,735, to form the bore 42 by cutting coal from the coal seam 54.

The coal seam 54 typically is one having an average thickness of about four feet or less, preferably an average thickness of about three feet or less, and the machine 1 is ideally suited for coal seams 54 having an average thickness of about two feet or less. FIG. 5 schematically illustrates a machine 1 being used to mine a seam 54 wherein the machine 1 has a chassis height 55 (see FIG. 1) that is a maximum of about twenty inches, preferably about nineteen inches, while the cutter head 14 has a maximum diameter 56 (see FIG. 1) of about twenty-two inches, e.g. preferably about twenty-one inches. The mining machine 1 also preferably has a length 58 (see FIG. 1) that is small enough to allow the machine 1 to easily negotiate up and down within the seam 54. While the CM 245 has a length of about 33–34 feet, it is preferred that the length 58 of the machine 1 be less than about thirty feet, e.g. about twenty-eight feet, or even less.

FIG. 5 schematically illustrates use of the machine 1 in a seam 54 that has an average thickness 57 of about twenty-four inches.

The left and right movement of the machine 1 may be controlled using conventional laser beams or the like, but the up and down movement within the thickness 57 of the seam 54 is preferably controlled by another novel aspect of the invention.

As schematically illustrated in FIG. 5, control of the up and down movement of the cutter head 14 (this may not be true up and down with respect to the earth, but up and down with respect to the thickness of the seam 54) is remotely controlled by a human operator operator at the bore 42 mouth 58 (see FIG. 6), or at some intermediate location within the bore 42. The human operator typically uses a television monitor 59 as an aid in determining how to control the cutter head 14. The monitor 59 is preferably connected up to at least a first color video camera 60, and preferably at least a second color video camera 61 is also used. A third color video camera (not shown) may also be utilized, to completely simulate the views that a human operator has when riding and operating conventional continuous miners.

The color video cameras 60, 61 may be of any suitable conventional type, such as a Toshiba CCD color camera, model no. IK-M41A, which has internal self-scanning. The cameras 60, 61 also preferably have an internal automatic lens cleaning device, developed by the Bureau of Mines, and known per se. The first video camera 60 is mounted, e.g. on the chassis 2 or associated with the cutter head 14 (e.g. on the boom 11), in a position where it can scan material being cut above the cutter head 14, i.e. at the ceiling 51 of the bore 42 as seen in FIG. 5. In this way the camera 60 can be used and utilizable to determine the color of the material being cut. If the cutter head 14 is cutting substantially exclusively within the coal seam 54, the ceiling 51 will be basically black since there will be at least a small thickness of coal between it and the overlying rock 63. However if the cutter head 14 starts cutting a significant amount of rock 63 the color of the ceiling 51 will change, which can be easily seen by the operator utilizing the monitor 59, the picture of the ceiling 51 being transmitted by the first camera 60 either by electromagnetic propagations, or through an appropriate cable, to monitor 59.

Similarly the second color video camera 61 is mounted to the chassis 2 or the cutter head (e.g. the boom 11) in a position to scan the floor 41 cut by the mining machine 1 and utilizable to determine the color thereof. Again if the cutter head 14 is cutting primarily in the seam 54 the floor 41 will be essentially black, whereas if a significant amount of the rock under burden 63 is being cut the color will change and that will be transmitted to the monitor 59.

While a single monitor 59 is illustrated in FIG. 5 it is to be understood that different monitors may be associated with the cameras 60, 61. Alternatively, the images from one of the cameras 60, 61 may be displayed on the monitor 59 at one time while the other is not, the display changing under operator control or periodically, or an image from each of the cameras 60, 61 may be displayed in different sections of the monitor 59 at the same time. Any appropriate light (or other electromagnetic propagation) source may be utilized to illuminate the area being viewed by one or both of the cameras 60, 61 if necessary or desirable.

If a third video camera is provided it points rearwardly of the machine 1 in the bore 42, so that the cameras simulate completely normal viewing positions of the human operator. Alternatively one of the cameras 60, 61 may periodically automatically (or by a human operator at the monitor 59 actuating the control) be moved to a position in which it pointed rearwardly, and then returned to its original position.

The mining machine 1 according to the present invention is typically utilized to form a bore 42 that has a length 65 (see FIG. 6) of between about 300–600 feet, i.e. much longer than the bore that can be formed by an auger. Also the bore will, of course, have the configuration of the cutter head 14 and the rest of the machine 1, i.e. be substantially rectangular in cross-section rather than circular. While the machine 1 may be utilized merely to form a conventional bore 42 and then be withdrawn, according to the invention it may utilized in another simple but straight-forward method that will allow the mining of additional coal from the seam 54 by a single penetration.

Figure 6:
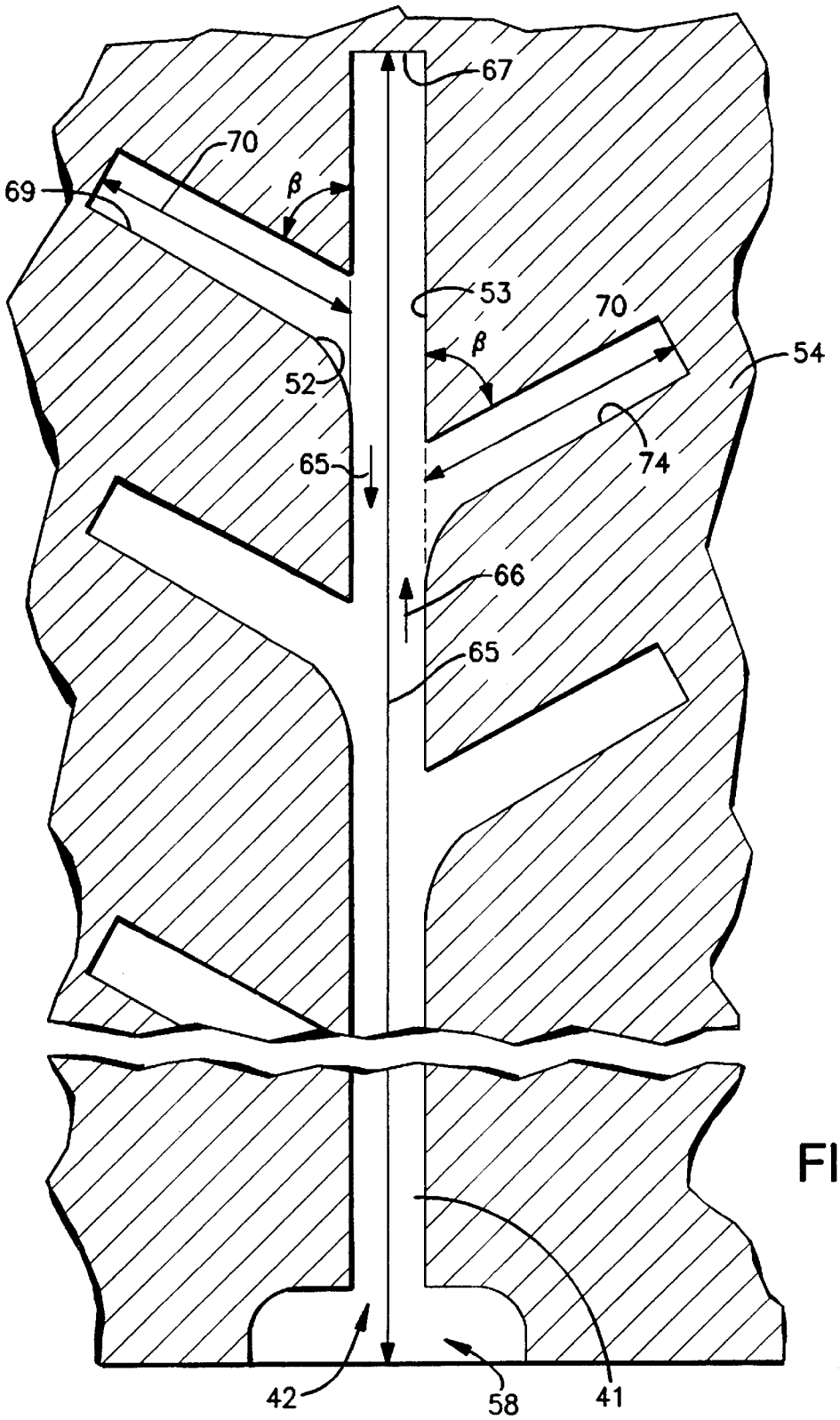
FIG. 6 is a schematic top longitudinal cross-sectional view of a coal seam that has been mined utilizing the miner of FIGS. 1 through 5 in a novel mining technique.

As schematically illustrated in FIG. 6 (with reference to FIG. 5 too) the main mine bore 42 is formed having first and second side walls 52, 53, a roof 51, and a floor 41 by powering the crawler tracks 3 and cutter head 14 to move the continuous miner through the mine mouth 58 into the coal seam 54 a depth of more than 150 feet in the direction 66, while the coal in seam 54 is being cut and conveyed toward the mouth 43 using a conveyor 4 and a conveyor 33. Once the desired depth 65 of penetration (which is preferably between about 300–600 feet) is reached, the final end wall 67 (see FIG. 6) having been formed, the miner 1 is retracted (utilizing the crawler tracks 3) a distance in the second direction 68, opposite the penetration direction 66, of greater than about ten feet e.g. a distance of about twenty-five feet. After this retraction a secondary mine bore 69 (see FIG. 6) is formed by powering the crawler tracks 3 and the cutter head 14 to move the continuous miner 1 into the coal seam 51 through the side wall 52 at an angle β of greater than about 20° and less than about 80° (preferably about 30°–50°) to the first direction 66 for a distance 70 roughly equal to the length 58 of the mining machine 1, while cutting coal and conveying coal toward the mouth using the conveyors 4, 33. Because of the articulated joint 6, and because the conveyors 33 are also mounted in such a way that they are articulated with respect to the machine 1, this turning penetration is possible to form the bore 69, which may also require moving of the cutter head 14 up and down or from side to side slightly initially to effect the necessary penetration of the side wall 52.

After forming the secondary bore 69, the machine 1 is again controlled by the operator to move the crawlers 3 (and the cutter head 14 if necessary) to withdraw from the bore 69 to move back into the main bore 42. The machine 1 is then again retracted a distance in the direction 68 of at least about ten feet from the secondary bore 69, and then the step of forming a secondary bore is repeated. Preferably this is accomplished by penetrating the second side wall 53 to form another secondary bore 71 essentially the same as the bore 69 only penetrating the side wall 53, and again penetrating a distance 70 roughly equal to the length 58 of the machine 1 (e.g. about 20–40 feet). These steps may be repeated as many times as desired preferably alternating between penetration of the first wall 52 and the second wall 53, as schematically illustrated in FIG. 6, all the way back to the mouth 58.

As yet another alternative to the method described above, after initial formation of the bore 42 the machine 1 may be withdrawn with the cutter head 14 moved upwardly to cut enough extra height so that a human operator may appropriately enter the bore 42. This would typically entail cutting a substantial amount of rock, which would also be conveyed to the mouth 58 and separated from any coal that was cut in a conventional manner. The machine 1 would then enter the already formed and relatively high bore 42 again, with the human operator behind, and then the human operator would control the machine 1 at specified locations to form the secondary bores 69, 71, as appropriate.

It will thus be seen that according to the present invention a mining machine, and a method of utilization thereof, have been provided which provide effective mining of thin coal seams, particularly those having a thickness of about four feet or less, including those having a thickness of about three feet or less, and even those having a thickness of about two feet or less. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A continuous mining machine comprising:

a chassis supported by crawler tracks, and having a front and a rear and elongated in a first dimension between said front and said rear;

a powered substantially horizontal axis cutter head mounted to said front of said chassis;

a conveyor mounted to said chassis and including an endless conveyor chain;

said chain connected to first and second sprockets, said first sprocket mounted for rotation about a first shaft adjacent said rear of said chassis, and said second sprocket mounted for rotation about a second shaft adjacent said front of said chassis but between said first sprocket and said cutter head;

said first and second shafts rotatable about axes generally perpendicular to said first dimension;

at least one motor mounted adjacent said rear of said chassis for driving said first shaft to thereby drive said first sprocket and said conveyor; and wherein said chassis has a maximum height of about twenty inches, and wherein said cutter head has a maximum diameter of about twenty two inches.

2. A mining machine as recited in claim 1 wherein said second shaft comprises an idler shaft.

3. A mining machine as recited in claim 2 further comprising a gathering head mounted adjacent said front of said chassis and below said cutter head and at least partly to the rear of said cutter head, for gathering material cut by said cutter head and moving the cut material to said conveyor.

4. A mining machine as recited in claim 1 further comprising a first color video camera mounted on said chassis or said cutter head in a position to scan material being cut above said cutter head and determine the color thereof, said first video camera connected to a monitor to the rear of said chassis.

5. A mining machine as recited in claim 4 wherein said mining machine forms a floor during operation; and further comprising a second color video camera mounted to said chassis or said cutter head in a position to scan the floor cut by said mining machine to determine the color thereof, said second video camera connected to said monitor.

6. A mining machine as recited in claim 1 wherein said at least one motor comprises two motors, one on either side of said chassis, and wherein said motors are operatively connected to said first shaft through splined telescoping transmission shafts, and gear boxes.

7. A continuous mining machine as recited in claim 1 wherein said cutting head includes a cutting chain drive sprocket with a maximum diameter of about 7.5 inches.

8. A mining machine as recited in claim 7 wherein said second sprocket has a maximum diameter of about eight inches.

9. A continuous mining machine comprising:

a chassis supported by crawler tracks, and having a front and a rear and elongated in a first dimension between said front and said rear;

a powered substantially horizontal axis cutter head mounted to said front of said chassis;

a conveyor mounted to said chassis and including an endless conveyor chain;

said chain connected to first and second sprockets, said first sprocket mounted for rotation about a first shaft adjacent said rear of said chassis, and said second sprocket mounted for rotation about a second shaft adjacent said front of said chassis but between said first sprocket and said cutter head;

said first and second shafts rotatable about axes generally perpendicular to said first dimension;

at least one motor mounted adjacent said rear of said chassis for driving said first shaft to thereby drive said first sprocket and said conveyor;

a gathering head mounted adjacent said front of said chassis and below said cutter head and at least partly to the rear of said cutter head, for a gathering material cut by said cutter head and moving the cut material to said conveyor;

wherein said gathering head comprises a pair of counter-rotating discs with upstanding vanes, and an angled deck substantially coplanar with said discs; and wherein said second shaft has first and second transmission elements connected thereto, said first and second transmission elements operatively connected to said discs for effecting counter-rotation driving thereof.

10. A mining machine as recited in claim 9 wherein said angled deck during normal operation makes a maximum angle of about 10° with respect to said dimension of elongation of said chassis.

11. A mining machine as recited in claim 9 wherein said second sprocket has a maximum diameter of about eight inches and is mounted beneath said deck, and wherein said cutting head includes a cutting chain drive sprocket with a maximum diameter of about 7.5 inches.

12. A mining machine as recited in claim 11 further comprising a plurality of cross bars connected to said chain for moving conveyed material from said gathering heads to said rear of said chassis; and wherein said second sprocket comprises a four tooth sprocket, and wherein said cutting chain drive sprocket of said cutting head comprises a five tooth sprocket.

13. A continuous mining machine comprising:

a chassis supported by crawler tracks, and having a front and a rear and elongated in a first dimension between said front and said rear;

a powered substantially horizontal axis cutter head mounted to said front of said chassis, a conveyor mounted to said chassis and including an endless conveyor chain;

said chain connected to first and second sprockets, said first sprocket mounted for rotation about a first shaft adjacent said rear of said chassis, and said second sprocket mounted for rotation about a second shaft adjacent said front of said chassis but between said first sprocket and said cutter head;

said first and second shafts rotatable about axes generally perpendicular to said first dimension;

at least one motor mounted adjacent said rear of said chassis for driving said first shaft to thereby drive said first sprocket and said conveyor;

a gathering head mounted adjacent said front of said chassis and below said cutter head and at least partly to the rear of said cutter head, for gathering material cut by said cutter head and moving the cut material to said conveyor, said gathering head comprising a pair of counter-rotating discs with upstanding vanes, and an angled deck substantially coplanar with said discs;

wherein said second shaft has first and second transmission elements connected thereto, said first and second transmission elements operatively connected to said discs for effecting counter-rotation driving thereof;

wherein said angled deck during normal operation makes a maximum angle of about 10° with respect to said dimension of elongation of said chassis; and wherein said second sprocket has a maximum diameter of about eight inches and is mounted beneath said deck.

14. A method of mining coal in seams having an average thickness of less than four feet using a continuous mining machine having a chassis mounted by crawler tracks, a cutter head at the front of the chassis, an articulated rear end, a first conveyor for conveying cut coal from the cutter head to the rear of the chassis, and a second conveyor operatively associated with the rear end to convey coal from a bore toward a mouth of the bore, the continuous miner having a predetermined length from the cutter head to the rear of the chassis; said method comprising the steps of:

(a) forming a main mine bore, having first and second side walls, a roof, and a floor, by powering the crawler tracks and cutter head to move the continuous miner through the mine mouth into the coal seam having an average thickness of less than four feet, a depth of more than 150 feet in a first direction, while cutting coal and conveying the coal toward the mouth using the first and second conveyors;

(b) after the practice of step (a), retracting the continuous miner a distance of greater than about ten feet; and (c) after the practice of step (b), forming a secondary mine bore by powering the crawler tracks and the cutter head to move the continuous miner into the coal seam through the main mine bore side walls at an angle of greater than about 20° and less than about 80° to the first direction for a distance roughly equal to the predetermined length of the miner, while cutting coal and conveying cut coal toward the mouth using the first and second conveyors.

15. A method as recited in claim 14 comprising the further step (d) of repeating steps (b) and (c) at least once after the practice thereof; and wherein the coal seam has an average thickness of about three feet or less.

16. A method as recited in claim 15 wherein step (c) is practiced by moving the miner into contact with the first side wall of the main bore, and wherein step (d) is practiced first after step (c) by moving the miner into contact with the second side wall of the main bore.

17. A method as recited in claim 16 wherein step (d) is practiced a plurality of times, alternating between moving the miner into contact with the first side wall of the main bore and the second side wall of the main bore.

18. A method as recited in claim 15 wherein steps (c) and (d) are practiced to penetrate the side walls a distance of between about 20–40 feet in forming each secondary bore.

19. A method as recited in claim 15 wherein during the practice of step (a) the miner is remotely controlled by a human operator, and wherein the miner has at least a first color video camera mounted thereon; and comprising the further step (d) of scanning the roof of the bore adjacent the cutter head to determine the color thereof, and then the human operator adjusting, if necessary, the position of the cutter head and the vertical orientation of the miner in response to that scanning.

20. A method as recited in claim 19 wherein the miner has a second color video camera mounted thereon; and comprising the further step (e) of scanning the floor of the bore with the second video camera to determine the color thereof, and then the human operator adjusting, if necessary, the position of the cutter head and the vertical orientation of the miner in response to that scanning.

21. A method as recited in claim 15 wherein step (a) is practiced to penetrate the coal seam a distance of between about 300–600 feet.

22. A method as recited in claim 21 wherein steps (c) and (d) are practiced to penetrate the coal seam a distance of between about 20–40 feet in forming each secondary bore.

23. A method as recited in claim 14 wherein the coal seam has an average thickness of about two feet or less.

24. A method as recited in claim 23 wherein step (a) is practiced to penetrate the coal seam a distance of between about 300–600 feet.

25. A continuous mining machine comprising:

a chassis supported by crawler tracks, and having a front and a rear and elongated in a first dimension between said front and said rear;

a substantially horizontal axis powered cutter head mounted to said front of said chassis;

a conveyor mounted to said chassis and including an endless conveyor chain;

said chain connected to first and second sprockets, said first sprocket mounted for rotation about a first shaft adjacent said rear of said chassis, and said second sprocket mounted for rotation about a second shaft adjacent said front of said chassis but between said first sprocket and said cutter head;

said first and second shafts rotatable about axes generally perpendicular to said first dimension;

at least one motor for driving one of said first and second shafts to thereby drive one of said sprockets and said conveyor;

a gathering head mounted adjacent said front of said chassis and below said cutter head and at least partly to the rear of said cutter head, for gathering material cut by said cutter head and moving the cut material to said conveyor, said gathering head comprises a pair of counter-rotating discs with upstanding vanes, and an angled deck substantially coplanar with said disc;

said second shaft having first and second transmission elements connected thereto, said first and second transmission elements operatively connected to said discs for effecting counter-rotation driving thereof;

said angled deck during normal operation making a maximum angle of about 10° with respect to said dimension of elongation of said chassis; and said chassis having a maximum height of about twenty inches, and said cutter head having a maximum diameter of about twenty two inches.

26. A mining machine as recited in claim 25 wherein said second sprocket has a maximum diameter of about eight inches and is mounted beneath said deck.

27. A mining machine as recited in claim 26 wherein said cutting head includes a cutting chain drive sprocket with a maximum diameter of about 7.5 inches.

28. A mining machine as recited in claim 27 wherein said second sprocket comprises a four tooth sprocket, and wherein said cutting chain drive sprocket of said cutting head comprises a five tooth sprocket.

29. A continuous mining machine comprising:

a chassis supported by crawler tracks, and having a front and a rear and elongated in a first dimension between said front and said rear;

a powered substantially horizontal axis cutter head mounted to said front of said chassis;

a conveyor mounted to said chassis and including an endless conveyor chain;

said conveyor chain connected to first and second sprockets, said first sprocket mounted for rotation about a first shaft adjacent said rear of said chassis, and said second sprocket mounted for rotation about a second shaft adjacent said front of said chassis but between said first sprocket and said cutter head;

said first and second shafts rotatable about axes generally perpendicular to said first dimension;

at least one motor mounted adjacent said rear of said chassis for driving said first shaft to thereby drive said first sprocket and said conveyor; and wherein said cutting head includes a cutting chain driven by a drive sprocket with a maximum diameter of about 7.5 inches.

30. A mining machine as recited in claim 29 wherein said cutting chain has an effective diameter at said drive sprocket of about 16 inches or less, and wherein said cutting head further comprises a driven sprocket having a maximum diameter of about 14 inches.

* * * * *